US011535991B2

(12) United States Patent
Tryon et al.

(10) Patent No.: US 11,535,991 B2
(45) Date of Patent: Dec. 27, 2022

(54) NOISE ATTENUATING BARRIER AND METHOD OF INSTALLING SAME

(71) Applicants: Mark Adam Tryon, Aurora, IL (US); Allan Thomas Myket, Naperville, IL (US)

(72) Inventors: Mark Adam Tryon, Aurora, IL (US); Allan Thomas Myket, Naperville, IL (US)

( * ) Notice: Subject to any disclaimer, the term of this patent is extended or adjusted under 35 U.S.C. 154(b) by 988 days.

(21) Appl. No.: 16/275,453

(22) Filed: Feb. 14, 2019

(65) Prior Publication Data

US 2020/0263370 A1 Aug. 20, 2020

(51) Int. Cl.

| | |
|---|---|
| ***E01F 8/00*** | (2006.01) |
| ***E04H 17/16*** | (2006.01) |
| ***G10K 11/162*** | (2006.01) |

(52) U.S. Cl.

CPC ..... *E01F 8/0017* (2013.01); *E01F 8/0023* (2013.01); *E04H 17/16* (2013.01); *G10K 11/162* (2013.01)

(58) Field of Classification Search

CPC ..... E01F 8/0017; E01F 8/0023; E01F 8/00; E01F 8/0005; G10K 11/162; G10K 11/16; E04H 17/16

USPC ..... 181/210, 285

See application file for complete search history.

(56) References Cited

U.S. PATENT DOCUMENTS 3,626,650 A * 12/1971 Lickliter et al. .... E04F 13/0803 52/762
3,722,928 A * 3/1973 Skubic ..... F16B 5/0685 217/43 A
3,732,653 A * 5/1973 Pickett ..... E04H 17/16 256/26
3,952,471 A * 4/1976 Mooney ..... E04B 1/04 52/781.5
4,887,691 A * 12/1989 Rotondo ..... E02D 27/42 52/144
4,918,891 A * 4/1990 Gerszewski ..... E02D 27/02 52/741.15

(Continued)

FOREIGN PATENT DOCUMENTS

CN 209227833 U * 8/2019 ..... E04B 1/41
DE 102011110848 A1 * 2/2013 ..... E04H 17/1421

(Continued)

*Primary Examiner* — Edgardo San Martin
(74) *Attorney, Agent, or Firm* — Wood, Phillips, Katz, Clark & Mortimer

(57) ABSTRACT

A noise abating wall including piers with integral column members, columns each including two laterally extending wing walls, and a spandrel panel. The piers are secured in spaced ground holes with column members extending vertically from the pier securing the columns in a vertical orientation with the wing wall outer sides having a selected spacing from one wing wall of an adjacent column. The spandrel panels are wider than the selected spacing of wing walls of adjacent columns whereby the spandrel panel sides overlap the sides of adjacent wing walls. First connectors on the spandrel panel front face adjacent both of the panel opposite sides and second connectors on the wing wall rear faces adjacent the wing wall outer sides connect together to secure the overlapping walls and spandrel panels in substantially face to face contact.

15 Claims, 9 Drawing Sheets

(56) References Cited

U.S. PATENT DOCUMENTS 5,011,325 A * 4/1991 Antonioli ..... E01F 15/086 404/6
5,022,781 A * 6/1991 Smith ..... E01F 9/669 404/34
5,134,815 A * 8/1992 Pickett ..... E04H 17/1404 52/592.4
5,218,797 A * 6/1993 Kruse ..... E04B 1/86 52/468
5,400,563 A * 3/1995 House ..... E04H 17/16 52/745.1
5,426,267 A * 6/1995 Underhill ..... E01F 8/0011 181/290
5,965,852 A * 10/1999 Roschke ..... E01F 8/0017 181/210
6,434,900 B1 * 8/2002 Masters ..... E04G 21/142 256/73
6,594,963 B1 * 7/2003 Bennett ..... E04H 17/16 52/297
6,755,394 B2 * 6/2004 Forbis ..... E04H 17/16 256/65.01
8,776,945 B2 * 7/2014 Zimmerman ..... E01F 8/0011 181/210
11,060,275 B2 * 7/2021 Kucera ..... E04F 13/14
2003/0143038 A1 * 7/2003 Babcock ..... E02D 5/808 52/153
2011/0067341 A1 * 3/2011 Smith ..... E02D 29/02 52/745.1
2012/0304564 A1 * 12/2012 Kurczynski ..... E02D 27/04 52/293.3
2013/0180799 A1 * 7/2013 Tizzoni ..... E01F 8/0023 181/296
2013/0287484 A1 * 10/2013 Phillips ..... F16B 12/26 403/298
2015/0267403 A1 * 9/2015 Ho ..... E04B 1/994 181/210
2016/0177534 A1 * 6/2016 Heraty ..... E02D 17/20 405/285

FOREIGN PATENT DOCUMENTS

DE 102019202313 A1 * 8/2020
EP 1445381 A1 * 8/2004 ..... E01F 8/0017
KR 20150102569 A * 9/2015 ..... E02D 27/32
KR 101561212 B1 * 10/2015 ..... E01F 8/0023
KR 102279079 B1 * 7/2021 ..... E01F 8/0023
KR 20220001271 A * 1/2022 ..... E01F 8/0023
WO WO-02064891 A1 * 8/2002 ..... E01F 8/0023

* cited by examiner 96
70
64
96
96
70
62
96
96
96
60
96
86
96
50
54
84

NOISE ATTENUATING BARRIER AND METHOD OF INSTALLING SAME

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD OF THE INVENTION

The present invention relates to noise attenuation and more particularly to barriers blocking noise emanating from noisy areas.

BACKGROUND OF THE INVENTION

Noise abatement walls or noise barriers are known, with extensive use of noise walls having begun in the U.S. after noise regulations were introduced in the early 1970's. This coincided with the suburban sprawl which resulted in the increased need to protect individuals with sensitive land use from the increased noise pollution. Noise Abatement Walls are also effective in large high density cities where residential developments are located adjacent to highway systems.

Noise abatement walls typically incorporate vertical column elements constructed of either precast concrete or standard rolled steel sections. The columns cantilever from a foundation system that typically consists of a deep drilled cast-in-place concrete foundation system such as drilled cast-in-place concrete piers. The columns are spaced anywhere from 5 to about 20 feet on center laterally and have been one-piece or two-piece column sections that either extend into the ground incorporating a foundation element of the column or a cast-in-place concrete foundation and a post section that is mechanically joined to the concrete foundation, at or near grade, to act as one section with the foundation. A discussion of the common construction and design methods for concrete and/or steel Noise Abatement Wall installations defined above is further discussed below. Such noise abatement walls are constructed in a similar manner.

One configuration of such noise abatement walls uses one-piece precast concrete columns which incorporate both the below grade foundation pier and above grade exposed column in a single precast concrete length of column. This type of installation requires an oversized augured hole to be drilled with the column section set vertically, full height, plumbed/braced laterally, at the correct elevation and held in place while the drilled hole is backfilled using a CLSM (Controlled Low Strength Material) such as concrete or an engineered flowable fill. The one-piece precast concrete column extends up out of the CLSM pour extending up to the top elevation of the noise abatement wall.

This method of installation is difficult and costly because it is difficult to temporarily support the large weight of the full-length column section while also maintaining the plumbness until the CLSM has sufficiently cured to permanently support the one-piece column section. This usually requires the use of a portable crane during the full installation time of a column section which increases crane time for the project and therefore the cost of installation. This also requires the field crew to be more exacting in their setting of the column, adding more time per column installation, since any variance in plumbness or location can potentially impact the fit up of the remainder of the wall system. This method of construction and installation requires a number of field construction tasks in order to accomplish the setting of each full height column section, including auguring a hole, positioning and setting plumb the one-piece precast concrete column, supporting the full weight of one-piece precast concrete column by crane until CLSM has sufficiently cured, laterally bracing the precast concrete column section, pouring the CLSM in augured hole around embedded section of one-piece precast concrete column, and stripping and removing the lateral bracing.

Another configuration of such noise abatement walls uses two-piece concrete columns which incorporate a separate below grade cast-in-place concrete drilled pier foundation and a separate above grade exposed precast concrete column section. The concrete cast-in-place drilled pier foundation and precast concrete column sections are joined at approximately grade elevation using a traditional steel precast column base connection (e.g., at least four vertical steel anchor rods embedded into the lower cast-in-place drilled pier foundation and extending above the cast-in-place drilled pier foundation and extending through holes in a steel base plate embedded into the base of the above grade precast concrete column section). In such configurations, the concrete above the base plate at the locations of the anchor rods is blocked out in the above grade precast concrete column section in order to accommodate the tightening of a nut onto the threaded portion of each anchor rod. Installation requires even more on-site (field) tasks for each pier foundation than the one piece concrete columns, including setting and positioning a steel reinforcement cage in the augured hole, positioning of the anchor rods, tying off to the reinforcing cage and then pouring the cast-in-place concrete drilled pier foundation using the edge of the augured hole as an earth form (requiring the added cost of a concrete subcontractor and reinforcing supplier/subcontractor for accomplishing the concrete portion of the work), waiting for sufficient curing of entire pier foundation (typically a day), positioning the above grade exposed precast concrete column section on top of the cast-in-place drilled pier including plumbing and connecting the two pieces using the anchor rods, and hand packing grout to provide solid bearing surface between cast-in-place concrete foundation and precast concrete post.

Still another configuration of such noise abatement walls uses one-piece rolled steel columns which include both a below grade cast-in-place pier foundation component and an above grade exposed steel column component in a single full height rolled steel length of column. This type of installation requires an augured hole to be drilled with the column section set vertically, full height, plumbed and at the correct elevation and held in place while the drilled hole is back filled with cast-in place concrete. The steel column section extends near but not to (e.g., to within 6") of the bottom of the augured hole and is encapsulated into the concrete drilled pier pour. No reinforcing cage is used since the rolled steel section is designed to transfer the applied loading from the noise abatement wall to the concrete pier which is then distributed to the surrounding soil through the soil interface. The one-piece rolled steel column extends up out of the concrete drilled pier pour extending up to the top elevation of the noise abatement wall. Construction of these walls requires multiple trades and field crews who must be exact between drilled piers and steel work. The steel posts are typically wet-set by embedding them into the drilled piers while the pouring of the concrete cast-in-place concrete pier is being performed or by setting the steel and keeping it plumb while pouring in the concrete. Either option requires handling of the posts during the construction of the drilled pier which can lead to paint/galvanizing chipping and defects to the steel section. In addition, since the contracts of noise abatement wall projects are typically held by the precast manufacturer/contractor for the precast concrete panel portion of the wall, the rolled steel portion of the project is typically completed by a steel fabricator working as a subcontractor to the precast manufacturer/contractor, typically leading to an additional markup on the pricing of the steel portion of the materials of the project. Still further, the rolled steel column section is oversized in the design of this system compared to the steel column size needed to support the actual design loads on the wall system (rolled steel sections are not custom made for each project but instead are standard steel industry sizes, often resulting in use of sizes which are larger than required for the noise abatement wall). Moreover, since the column section is based on standard American Institute of Steel Construction (RISC) sections the depth, front to rear, of the rolled steel column is often deeper than the thickness of the precast wall spandrel panel that spans between the column sections, necessitating the use of custom steel bent plates welded to the inside of the back column flange to securely laterally support the precast wall spandrel. Such steel bent plates are typically spaced no further than 3'-0" to 4'-0" on center vertically for the exposed above grade height of the column, adding to the fabrication costs of the column section.

Further, when an installation of noise abatement walls with one-piece rolled steel columns requires a corner or kink where the wall cannot be straight, the fabrication and welding of the required additional bent plates can add significant cost and require more exact placement in the field to ensure the precast panels will fit and be aligned as required.

Still further, exposed steel columns are susceptible to corrosion thereby reducing their effective structural properties and strength over time, and thus the steel columns are commonly required to be hot dipped galvanized. This galvanic coating can help maintain the longevity of the system, but even then, the coating can be damaged during construction and sustained exposure and eventually fail, allowing corrosion to occur and requiring field maintenance over time to protect the rolled steel columns and adding additional cost to the wall.

Yet another configuration of such noise abatement walls uses two-piece rolled steel columns which incorporate a separate below grade cast-in-place concrete drilled pier foundation and a separate above grade exposed rolled steel column section. The concrete cast-in-place drilled pier foundation and rolled steel column sections are joined at approximately grade elevation using a traditional steel/foundation column base connection such as four vertical steel anchor rods embedded into the lower cast-in-place drilled pier foundation with a steel base plate secured to the base of the above grade column section (such as previously described in connection with the two piece concrete column configuration). Installation of such columns also requires a steel reinforcement cage set and correctly positioned in the augured hole, with the anchor rods positioned and stabilized by tying off to the reinforcing cage and then pouring the cast-in-place concrete drilled pier foundation using the edge of the augured hole as an earth form. As with the other configurations requiring anchor rods, construction and installation is costly since it requires a number of field construction tasks in order to accomplish the setting of the two-piece column section to form a single full height column. In addition, this configuration requires the added cost of a concrete subcontractor, and reinforcing supplier/subcontractor for accomplishing the concrete portion of the work, as well as typically also requiring a steel fabricator working as a subcontractor to the precast manufacturer/contractor. Further, as with one-piece rolled steel columns, the rolled steel column section is oversized relative to the need due to use of standard sizes, increasing material costs, and also necessitating use of multiple steel bend plates to properly secure wall spandrel panels to the columns, also adding material costs as well as adding fabrication costs Still further, cost adding galvanic coating is required in addition to the cost of field maintenance over time.

In addition to the problematic aspects of pier foundations of prior noise abatement walls, problems have existed with the precast concrete spandrel panels which span horizontally between column locations and forms the noise abatement wall. The precast concrete spandrel panels have commonly been either a separate piece with lengths approximately equal to the column spacing and height equal to the wall height or have been cast integrally with a single column at one end of the panel and a free end at the other with the free end connecting to the open side of an adjacent precast concrete end column. In some applications, the panels have been stacked vertically in order to create taller noise abatement walls.

Such precast concrete spandrel panels have varied in thickness but have typically been 4" to 5" in structural thickness with a surface roughness treatment on both sides of the wall, to make the wall more aesthetically pleasing and or perform better acoustically. The total thickness of the structural portion and the double-sided treatments have typically been upwards of 7" to 8". The precast concrete spandrel panels, if not cast integral with a column, have been hoisted vertically upward and slid down into a vertical slot/track located at the sides of the precast concrete or rolled steel column sections. The vertical weight of the installed spandrel panel is supported directly by bearing on the concrete pier located below each exposed column.

Since noise abatement walls typically follow alongside a road system or property line, the wall is required to follow the final vertical grade of the property on which it is installed. In order to do this, the spandrel panels have commonly been notched at their lower corners where they bear on the concrete piers at each side of the wall columns. This notch allows the bottom edge of spandrel panel to sit lower than the top of pier elevation and thereby roughly follow the grade at the bottom of the wall, with the depth and width of notches varying. These notches require custom spandrels, slowing and complicating the spandrel panel manufacturing and fabrication and increasing costs. In addition, typical wall project specifications for state transportation departments require that the wall be completely solid with no light or smoke able to penetrate through the wall system, which necessitates the costly manual application of a foam backer rod and fire retardant "structural caulk" for the full height of the column at the backside of the precast concrete spandrel panel at the interface between the panel and the column.

Height restrictions (e.g., overhead power lines and overhead bridges) limiting the accessibility to lift and set precast spandrel panels from up and above the top of steel posts can also complicate and increase costs. For example, the panels may necessarily either be cut into shorter panel sections (with, e.g., four or five panels between supporting posts, requiring additional horizontal joints that can affect the aesthetics of the wall system in addition to adding more field labor to caulk the additional joints. Another common practice for working around this type of restriction has been to remove a portion of the back flange of the steel columns in order to aid in the installation of the spandrel panels. However, this requires clip angles to be welded or bolted on in the field after the panels are installed and for the contractor to provide temporary shoring of the panels until the portion of the missing back flange of the steel posts is installed. Sometimes both options are used depending on the height restrictions or abilities of the contractor to lift and install the panels, all of which increase costs and time of installation.

The present invention is believed to overcome many of the above described difficulties of prior noise abatement walls.

SUMMARY OF THE INVENTION

In one aspect of the disclosure, a wall for abating noise from a noisy area is disclosed herein, including a plurality of columns each including a pair of wing walls extending laterally from the column, a spandrel panel, and connectors which secure overlapping sides of the wing walls and spandrel panel. The columns are secured in a vertical orientation adjacent the noisy area with the wing wall outer sides have a selected spacing from one wing wall outer side of an adjacent column. The connectors are on the spandrel panel face adjacent panel opposite sides and on the wing wall rear faces adjacent the wing wall outer sides and secure the overlapping walls and spandrel panel in substantially face to face contact.

In one form of this aspect of the disclosure, a plurality of piers each with a column member are secured in ground holes adjacent the noisy area with the column member extending vertically from the pier above the ground and into a center recess in one of the columns. In a further form, the piers are each precast concrete formed integrally with a steel pillar extending above the pier to define the column members.

In a still further form, the piers are each secured in a ground hole larger than the pier with fill closing the ground hole after the pier is positioned in the ground hole, where rebar extends down from the precast concrete pier and into the ground to secure the position of the pier as the fill is added to the ground hole. In yet a further form, a support stand secures the position of the pillar while fill is added to the ground hole. In a further form, the fill is CLSM concrete.

In a further form regarding the piers, a method of assembling the wall is provided, including the steps of (1) precasting a plurality of the piers, columns with wing walls and spandrel panels, (2) digging at least two ground holes adjacent the noisy area, (3) securing a pier in each ground hole with the pier column member oriented vertically, (4) adding CLSM fill to the ground holes and allowing the CLSM fill to cure around the pier, (5) lowering the columns onto the pier column members to secure the columns in a vertical orientation with wing walls of adjacent columns at the selected spacing. (6) suspending one of the spandrel panels above the ground between the wing walls of adjacent columns with the locking members of the first connectors higher than the locking members of the second connectors, (7) moving the suspended spandrel panel toward the wing walls to locate the first connectors in the second connector recesses with the first connector locking members behind the second connector locking members in the second connector recesses, and (8) lowering the suspended spandrel panel whereby the locking member sloped surfaces interact to bias the spandrel panel front face against the wing wall rear faces.

In another form of this aspect of the disclosure, the connectors on the spandrel panels include a plurality of projections from the spandrel panel front face adjacent the panel opposite sides, the connectors on the wing walls are a plurality of recesses into the wing walls through the wing wall rear faces adjacent the wing wall outer sides, and the spandrel wall connector projections when received in the wing wall connector recesses bias the spandrel panel front face into engagement with the rear faces of the wing wall. In a further form, the spandrel panel projections each include a downwardly extending locking member substantially parallel to the panel front face, the downwardly extending locking members each having a sloped surface generally facing the panel vertical front face, and the wing wall connector recesses each include a locking member substantially parallel to the wing wall rear face and extending upwardly from a bottom of the second connector recesses each having a sloped surface generally facing into the second connector recesses. In this further form, the spandrel panel connector downwardly facing members are located behind the wing wall connector upwardly facing members in the recesses with the downwardly extending locking member sloped surfaces engaging the upwardly extending locking member sloped surfaces whereby the locking member sloped surfaces interact to bias the spandrel panel front face against the wing wall rear faces.

In another aspect of the disclosure, a noise abating wall is provided including a plurality of piers with integral column members, a plurality of columns each including a pair of wing walls extending laterally from the column, and a spandrel panel having front and rear faces extending between opposite sides. Each of the piers is secured in ground holes adjacent the noisy area with the integral column member extending vertically from the pier above the ground and spaced from at least one adjacent pier. Each of the columns and included wing walls are integrally formed of precast concrete with each wing wall having front and rear faces extending laterally from the column to an outer side spaced from the column. The columns are each secured in a vertical orientation to the pier column members whereby the wing wall outer sides have a selected spacing from one wing wall outer side of an adjacent column secured to the adjacent pier. The opposite sides of the spandrel panels are spaced greater than the selected spacing of wing walls of adjacent columns whereby the spandrel panel front face adjacent one of the panel opposite sides overlaps the rear face of one of the wing walls of one of the adjacent columns, and the spandrel panel front face adjacent the other of the panel opposite sides overlaps the rear face of one of the wings walls of the other adjacent column. First connectors on the spandrel panel front face adjacent both of the panel opposite sides and second connectors on the wing wall rear faces adjacent the wing wall outer sides connect together to secure the overlapping walls and spandrel panels in substantially face to face contact.

In one form of this other aspect of the disclosure, the spandrel panels and wing walls are supported in a substantially vertical orientation.

In another form of this other aspect of the disclosure, the piers, columns and spandrel panels are formed of precast concrete prior to assembly at the noisy area.

In still another form of this aspect of the disclosure, the first connectors are a plurality of projections from the spandrel panel front face adjacent the panel opposite sides and the second connectors are a plurality of recesses into the wing walls through the wing wall rear faces adjacent the wing wall outer sides, wherein the first connector projections when received in the second connector recesses bias the spandrel panel front face into engagement with the rear faces of the wing wall. In a further form, the first connector projections each include a downwardly extending locking member substantially parallel to the panel front face, the downwardly extending locking members each having a sloped surface generally facing the panel front face; the second connector recesses each include a locking member substantially parallel to the wing wall rear face and extending upwardly from a bottom of the second connector recesses, the upwardly extending locking members each having a sloped surface generally facing into the second connector recesses; and the first connector downwardly facing members are located behind the second connector upwardly facing members with the downwardly extending locking member sloped surfaces engaging the upwardly extending locking member sloped surfaces whereby the locking member sloped surfaces interact to bias the spandrel panel front face against the wing wall rear faces.

In a further form of this aspect of the disclosure, a method of assembling the spandrel panels and wing walls is disclosed, including the steps of (1) suspending one of the spandrel panels above the ground, (2) positioning the suspended spandrel panel between adjacent spaced wing walls with the locking members of the first connectors higher than the locking members of the second connectors, (3) moving the suspended spandrel panel toward the wing walls to locate the first connectors in the second connector recesses with the first connector locking members behind the second connector locking members in the second connector recesses, and (4) lowering the suspended spandrel panel whereby the locking member sloped surfaces interact to bias the spandrel panel front face against the wing wall rear faces.

Other objects, features, and advantages of the invention will become apparent from a review of the entire specification, including the appended claims and drawings.

BRIEF DESCRIPTION OF THE DRAWINGS

FIG. 9 is an exploded perspective view showing the connector components which are integral with the spandrel panel and the wing walls, FIG. 10 is a side cross-sectional view showing the panel and wing wall connectors as positioned prior to connecting the panel to the wing walls, FIG. 11 is a side cross-sectional view showing the panel and wing wall connectors as the male connector is moved into engagement with the female connector, and FIG. 12 is a side cross-sectional view showing the panel and wing wall connectors in their connected position supporting and holding the panel and wing walls together;

DETAILED DESCRIPTION OF THE PREFERRED EMBODIMENT

Figure 1:
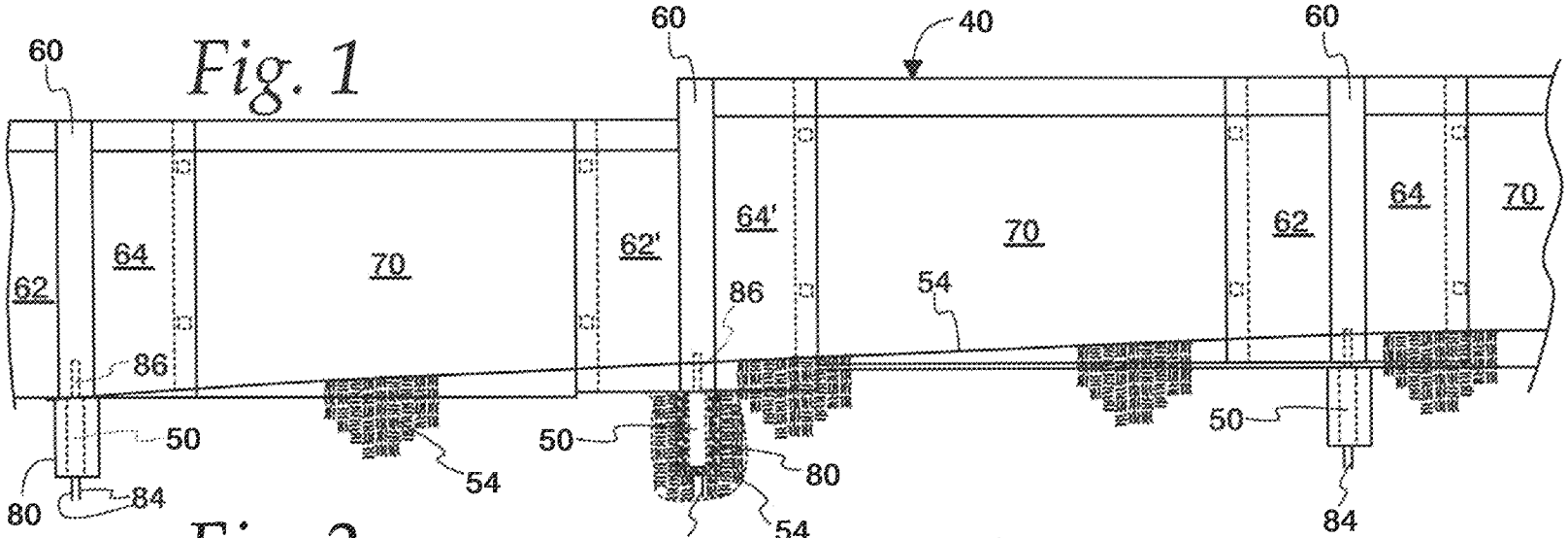
FIGS. 1 and 2 are front views of sound attenuating walls as disclosed herein.
Figure 2:
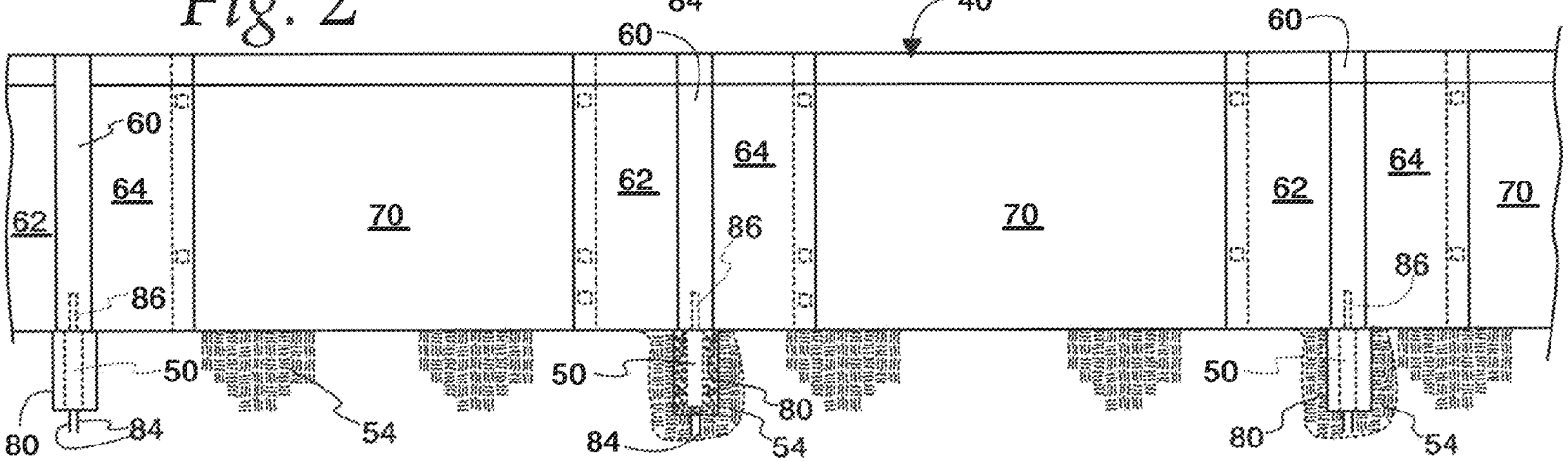

New and advantageous noise attenuating walls or barriers 40 are illustrated in FIGS. 1-2. In one form as illustrated in those figures, and as discussed in greater detail hereafter, the walls 40 include a plurality of spaced precast concrete piers 50 secured in the ground 54, each pier 50 supporting a column 60 which is precast monolithically and integrally with a pair of wing walls 62, 64 cantilevered on the column 60. A spandrel panel 70 on opposite sides overlaps with and is secured to the wing walls 62, 64 of adjacent columns to form the wall 40. The height of the spandrel panels 70 may be of any required height depending on the environmental requirements (with suitable piers 50 and columns 60), including up to at least thirty (30) feet.

The wall 40 shown in FIG. 1 is installed on uneven ground 54, and the wall 40' shown in FIG. 2 is on even ground 54'. For uneven ground as in FIG. 1, the wing walls are secured at different heights to the sides of the column 62 (see, e.g., wing walls 62',64' in FIG. 1)

Figure 3:
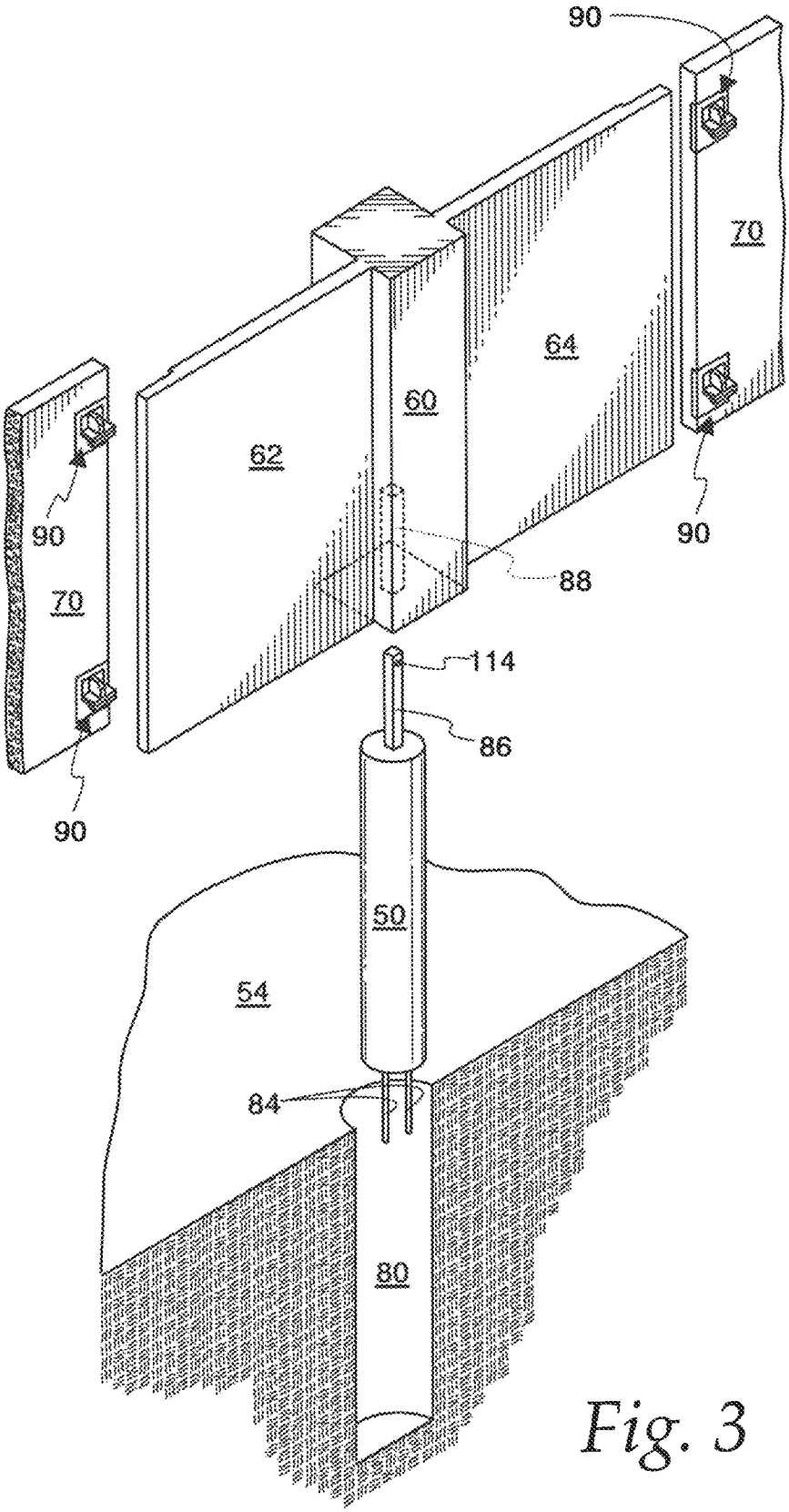
FIG. 3 is an exploded perspective view of the main components of the wall, namely the pier, the column with wing walls, and spandrel panels.

A portion of the walls 40 is also shown in exploded view in FIG. 3. As seen therein, a hole 80 is dug in the ground 54 and a pier 50 is lowered into the hole 80. The pier 50 is precast reinforced concrete including rebars 84 extending (e.g., about 18 inches) below the bottom of the pier 50 (to assist in ensuring the proper orientation of the pier 50 as described hereafter) and a column member 86 embedded in the pier so that a portion extends from the top of the pier 50.

The column 60 includes a recess or box-out 88 (see FIG. 3) in the bottom which receives the column member 86 when assembled such that the precast column 60 is supported by the pier 50 and its column member 86 in the desired (typically vertical) orientation. Advantageously, the column member 86 may be formed of a standard sized steel hollow structural section (HSS) designed to withstand the stresses of a particular installation, and typically would be of a size which would extend to at least about 6 inches of the bottom of the pier 50 and at least about four (4) feet above the pier 50 (and about four [4] feet into the column recess 88). It should be appreciated that in addition to supporting loads on the wall 40 over its life, the non-cylindrical shape of the column member 86 will also support the column 60 against unbalanced wind loads during construction (when, e.g., only one of the wing walls 62, 64 is secured to a spandrel panel 70). It should also be appreciated that the steel column members 86 are fully contained within precast box-outs 88 and thus are completely protected from the elements once the wall has been fully erected.

The spandrel panels 70 include male connectors 90 which are secured in female connectors 92 (see FIGS. 10-12) to secure the spandrel panels 70 between adjacent spaced wing walls 62, 64 as described in greater detail hereafter.

Figure 4:
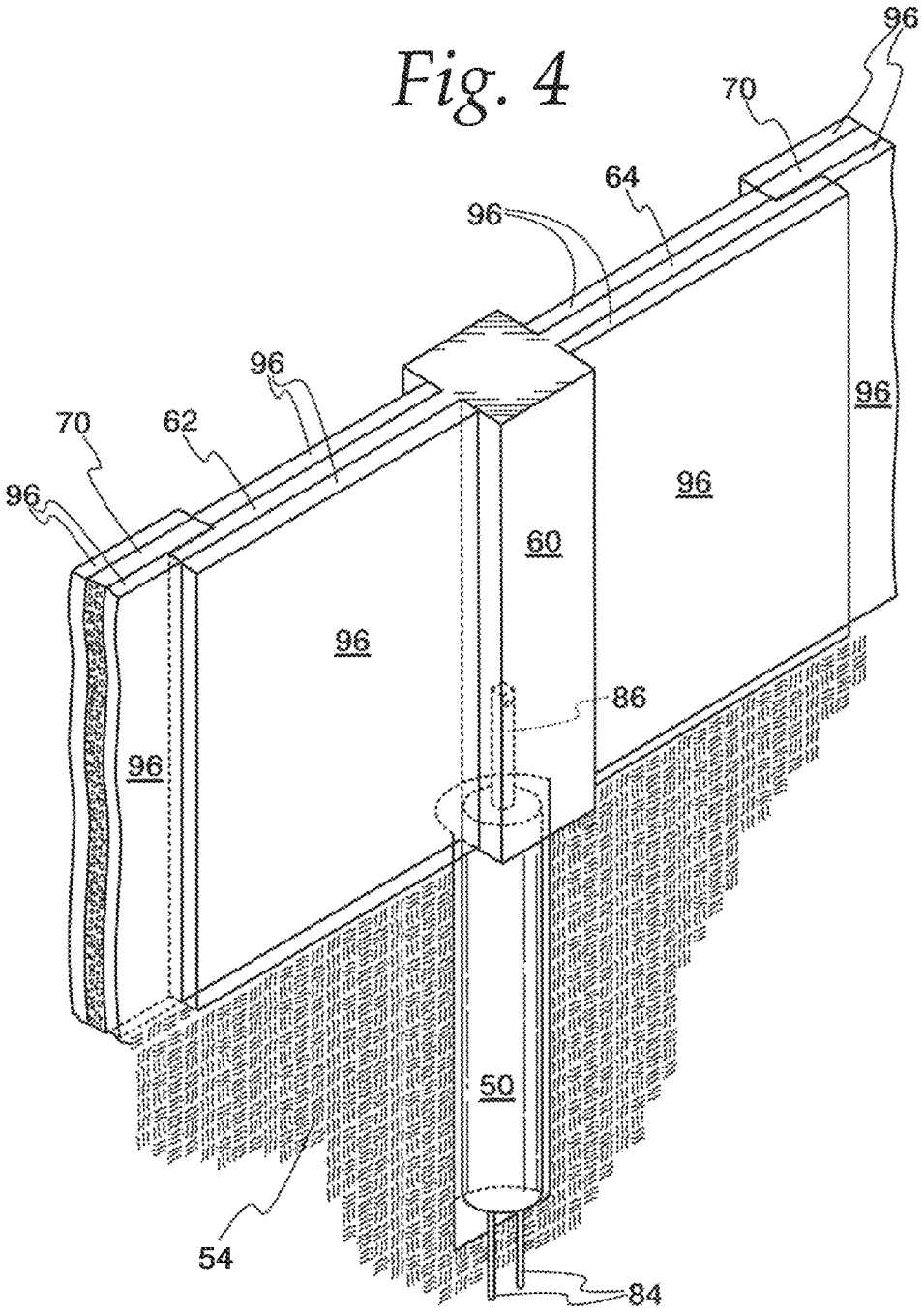
FIG. 4 is a perspective view of the wall as assembled, with sound attenuating and/or reflecting and/or aesthetic liners attached to the front and rear of the wing walls and spandrel panels.
Figure 5:
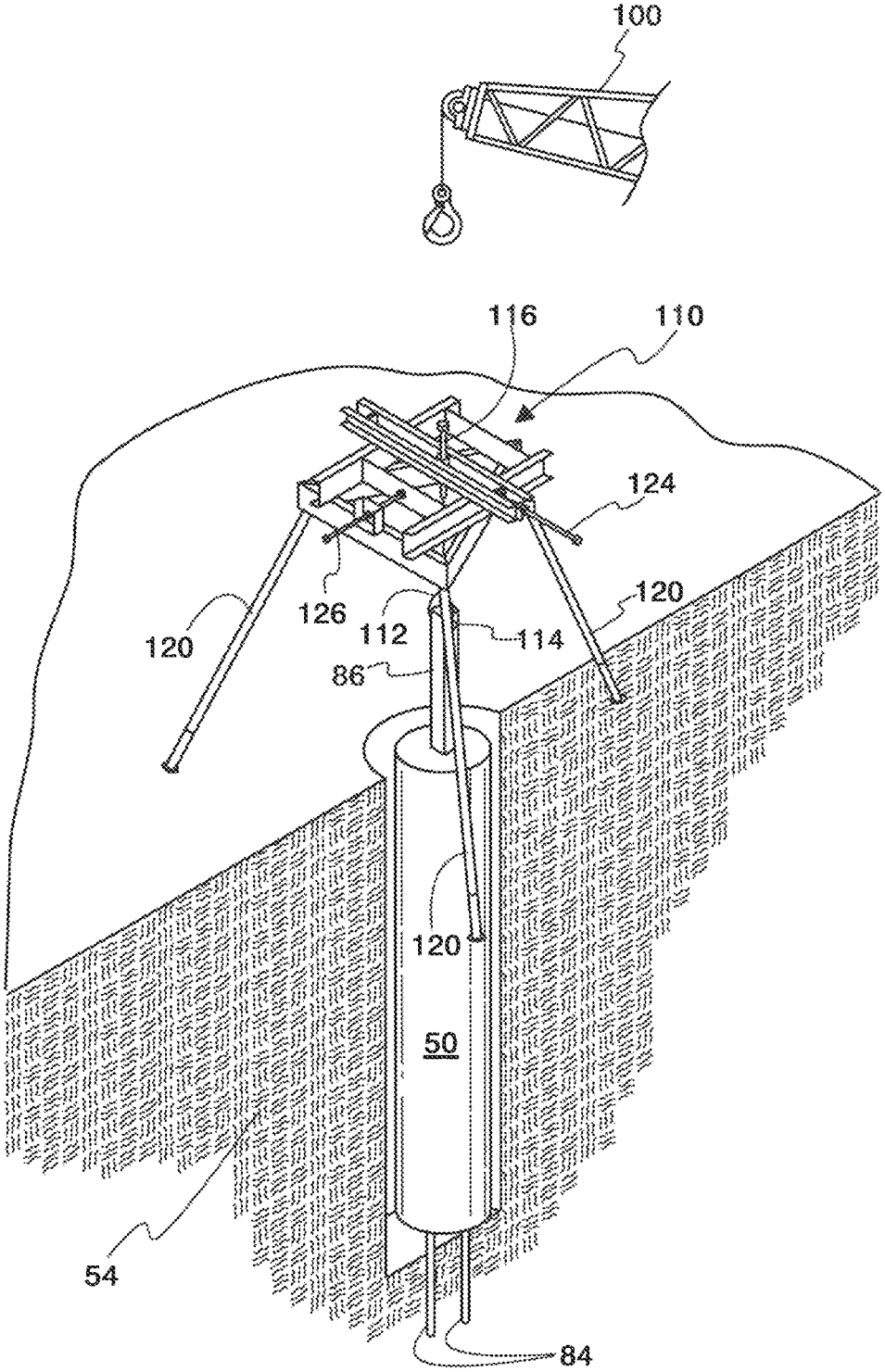
FIG. 5 is a partial cross-sectional view showing a pier as it is prepared for installation on-site in a ground hole.
Figure 6:
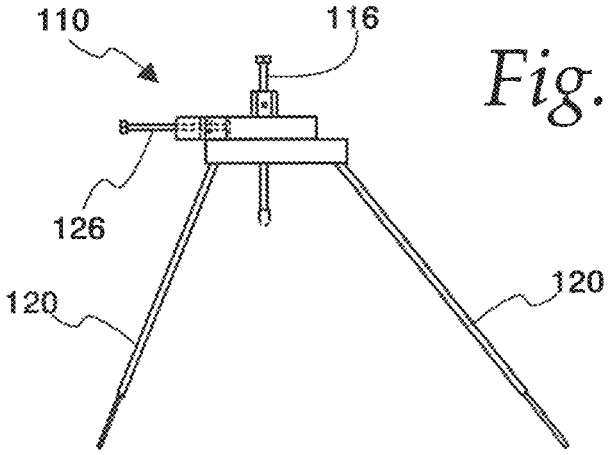
FIGS. 6-8 are front, side and top views of a support tripod which may be advantageously used to support a pier during the installation of the pier in an augured ground hole.
Figure 7:
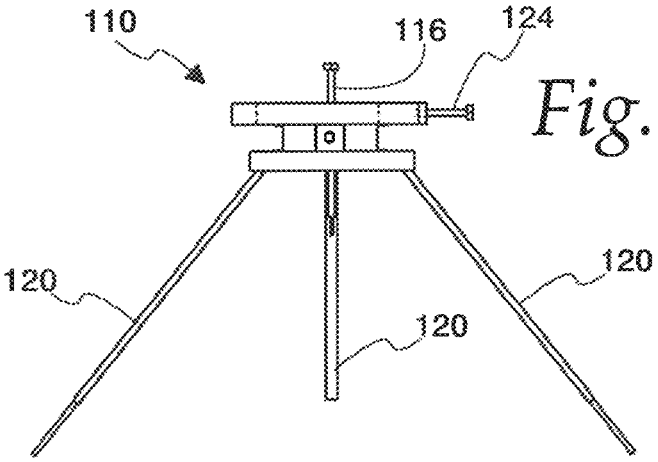
Figure 8:
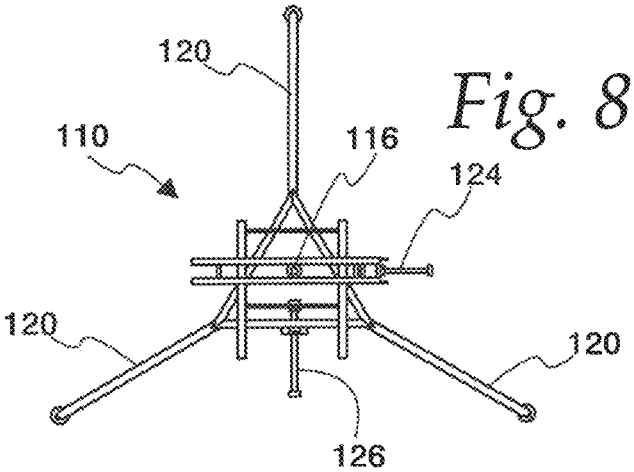
Figure 9:
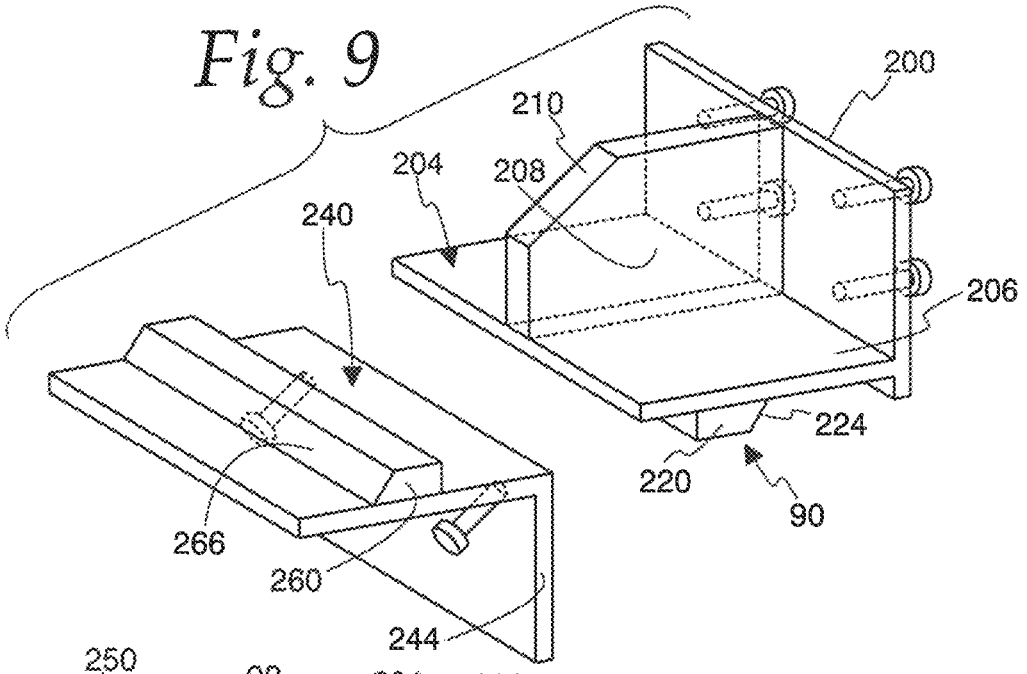
FIGS. 9-12 illustrate connectors which may be advantageously used to connect spandrel panels to column wing walls, where

As illustrated in FIGS. 4 (and 16), sound attenuating, absorptive, and/or reflective properties and/or aesthetic coatings or layers 96 may be added to the sides of the wing walls 62, 64 and spandrel panels 70, as long as the minimum required structural thickness of the spandrel panel 70 is maintained.

FIGS. 5-8 illustrate the advantageous manner and devices disclosed herein for on-site installation of the piers 50 in minimal time and with minimal use of lifting equipment such as cranes. Specifically:

a. Ground holes 80 are dug (e.g., by auguring) at each location where a pier 50 is to be located. Advantageously, the hole diameter should be larger than the diameter of the pier 50 and the bottom of the hole 80 should be deeper than the height of the pier 50. However, advantageously the bottom of the hole 80 should be no more than about 12 inches from the design bottom of the pier 50.

b. Each pier 50 may then be positioned in the desired vertical orientation in the ground holes 80 in a vertical orientation by a suitable lifting device such as a crane 100 (See FIG. 5). Advantageously, the pier 50 may be suspended beneath a support tripod 110 by, for example, a cable 112 secured to the pier 50 by looping through a hole 114 in the column member 86, with the cable 112 secured on its upper end to a vertical screw 116 of the support tripod 110.

c. The pier 50 when initially positioned properly is then lowered to its final orientation within the ground hole 80, with the downwardly extending rebars 84 penetrating the ground 54 at the bottom of the hole 80 to substantially secure the pier 50 in the desired vertical position spaced from the walls and bottom of the hole 80. Specifically, the rebars 84 will secure the bottom of the pier in place to prevent it from rotating or being laterally displaced when the hole 80 is thereafter backfilled with CLSM.

d. Once substantially secured in the desired position, the supporting tripod 110 may be adjusted to precisely orient the pier 50 into the desired position. Specifically, as seen in FIGS. 5-8, the tripod legs 120 may be adjusted so as to be firmly positioned on the ground 54 around the hole 80. Two orthogonal adjusting screws 124, 126 may then be adjusted to horizontally position the vertical screw 116 supporting the cable 110 so that the tripod 110 and the rebars 84 in the ground 54 cooperate to support the pier 50 in its exact design position. The vertical screw 116 may also be used to adjust the vertical position of the pier 50 and embedded column member 86 to the design height. Moreover, it should be appreciated that once the pier 50 is supported near its designed orientation by the support tripod 110, the crane 100 may be disengaged and used for installation of the next pier 50.

e. Fast setting CLM material may then be poured into the ground hole 80 around the pier 50 and allowed to set, securing the pier 50 in the ground hole whereby the piers 50 can support the wall 40.

It should be appreciated that use of multiple inexpensive support tripods 110 may be used simultaneously while the CLSM backfill is poured into the ground holes and while the CLSM sets. Thus, the supporting crane 100 need remain at the site of each pier 50 only until the pier 50 is sufficiently supported by the tripod 110, freeing the crane 100 to be used to position other piers 50 while precise adjustment using the screws 116, 124, 126 of the tripod 110 of the prior pier is done, as well as while backfilling of the ground hole 80, and setting of the CLSM occurs. This not only reduces the time during which the relatively costly crane 100 is required to install all of the piers, but also speeds the installation of the piers 50. Alternatively, stronger but slower setting backfill may be used to secure the piers 50, again without tying up the crane 100 as the backfill sets.

Once the piers 50 are secure, columns 60 may be installed by raising each over a column member 68 and then lowering the column 60 onto the column member 68 so that the column member 68 is received in the column recess 88, with the base of the column 60 bearing on the top surface of the pier 50. Additional hardware connecting the columns 60 to the piers 50 may not be required, with the design of the connection between the precast concrete foundation pier and the precast concrete integrated column creating cost savings by eliminating the need for connection hardware (i.e. washers and nuts) and the time needed to install in field. Further, manufacture of the piers 50 is simplified by, for example, eliminating the cast-in-anchor bolts in prior art systems, as well as eliminating the potential for such bolts being misaligned due to setting error in cast-in-place foundation piers or damaged prior to setting of prior art steel wall columns. Further, the disclosed pier 50 and column 60 connection eliminates the potential for the top surface of the cast-in-place concrete pier of being out of level or not smooth enough to fully bear the above grade column section, as well as eliminating any damage to exposed galvanized steel components (also eliminating the potential for corrosion of the steel columns).

FIGS. 9-12 illustrate male and female connectors 90, 92 which may be advantageously used to connect the spandrel panels 70 to installed column wing walls 62, 64.

The male connectors 90 include plates 200 suitably embedded in corners of the precast spandrel panels 70, with steel WT sections 204 welded to the plates 200 and projecting outwardly from the spandrel panels 70. The WT sections 204 include a horizontal plate 206 and a vertical supporting web 208 with a chamfer 210 at its outer end. Locking members or keeper bars 220 such as steel plates or teeth are suitably secured (e.g., by welding) to the bottom of the horizontal plates 206 and include a sloped surface 224 generally facing the face of the spandrel panel which is to be secured in abutment with the wing walls 62, 64.

The female connectors 92 include an embedded steel angle bearing angle or bent plate 240 integrally connected with the precast wing walls 62, 64, with a vertical section 244 extending along the face of the wing walls 62, 64 and a horizontal section 246 extending along the bottom of a recess 250 in the wing wall 62, 64. A locking member or keeper bar 260 such as a steel plate or tooth is suitably secured (e.g., by welding) to the top of the horizontal plate 246 and include a sloped surface 266 generally facing into the wing wall recess 250.

Assembly of the spandrel panels 70 between the wing walls 62, 64 of adjacent columns 60 can thus advantageously be accomplished as follows.

Figure 10:
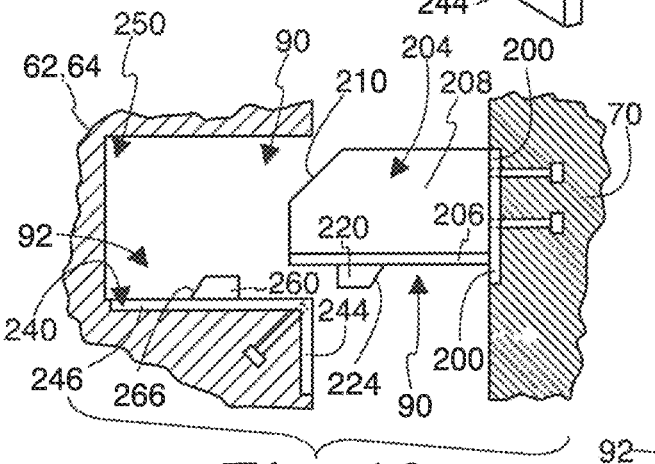
Figure 11:
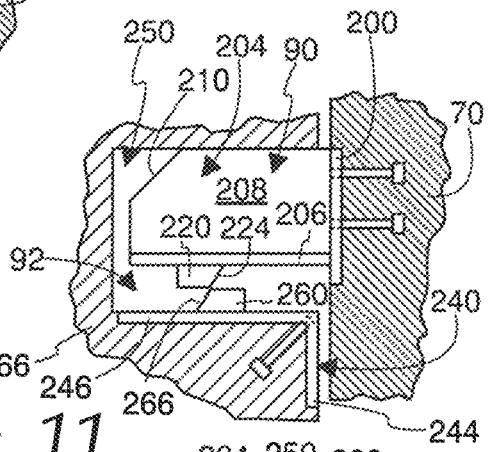
Figure 12:
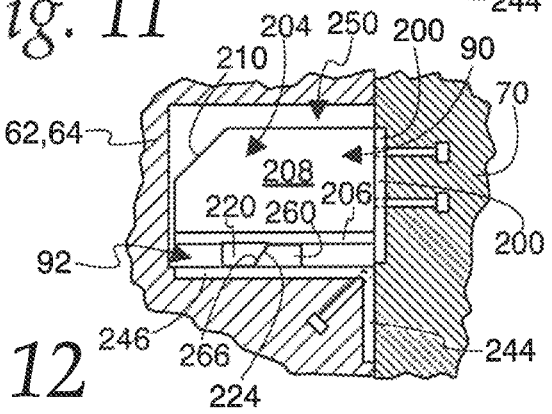
Figure 14:
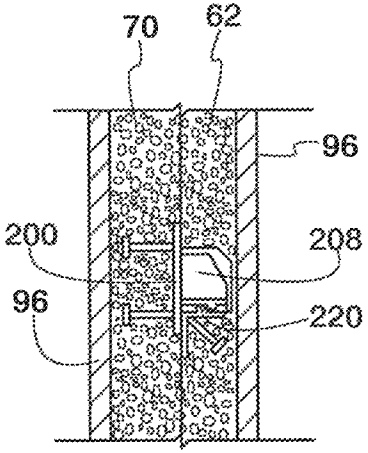
FIGS. 13-14 are cross-sectional views from the top and side of the engaged connectors, respectively.
Figure 13:
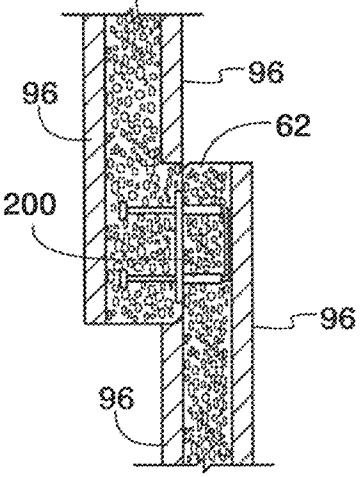
Figure 16:
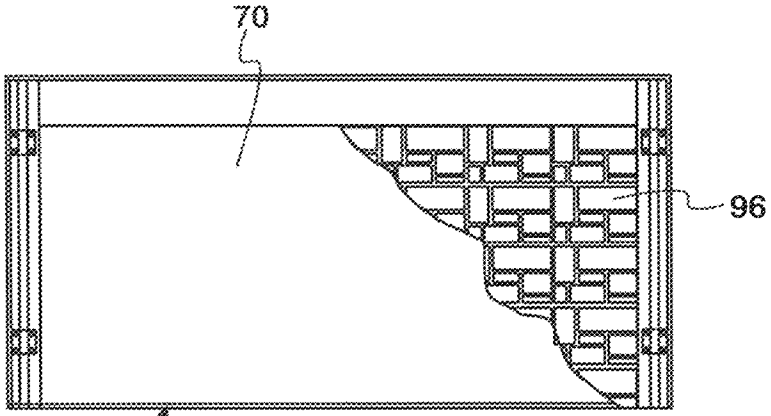
FIG. 16 is a front view of an alternate spandrel panel illustrating an aesthetic panel cover.

With the columns 60 supporting wing walls 62, 64 at sufficient spacing, a spandrel panel 70 may be lifted so that its ends are adjacent to and overlap the sides of the wing walls 62, 64. Moreover, the spandrel panel 70 may be supported such as shown in FIG. 10, wherein the projecting WT sections 204 are adjacent to the recess 250 of the wing wall female connectors 92 at a height in which the locking members 220 of the male connectors 90 are above the locking members 260 of the female connectors 92. At that point, the spandrel panel 70 may be moved toward the wing walls 62, 64 so that the WT sections 204 of the spandrel panel 70 move into the recesses 250 at the top and bottom of the adjacent wing walls 62, 64 with the male connector locking member 220 passing over and beyond the female connector locking member 260. When the locking members 220 clear the locking members 260, the spandrel panel 70 may be lowered and the sloped surfaces 224, 266 of the locking members 220, 260 will cooperate to pull the wing walls 62, 64 and spandrel 70 together, closing any gap between the spandrel panel 70 and wing walls 652, 64. It should be appreciated that the engaging sloped surfaces 224, 266 of the locking members 220, 260 could alternatively in some applications be vertical, or sloped in the direction opposite that of the sloped surfaces 224, 266 illustrated in FIGS. 9-12. In that case, the engaging surfaces may not bias the wing walls 62, 64 and spandrel panels 70 together, but they will provide increased locking strength to retain the wing walls 62, 64 and spandrel panels 70 together in the event, for example, that a strong horizontal load is encountered, such as from a collision or high wind load. Further, the weight of the spandrel panel 70 will, as shown in FIG. 12, secure the wing walls 62, 64 and spandrel panel 70 together as also shown in FIGS. 13 and 14.

For short wall heights, it may be acceptable to provide only one male/female connector 90, 92 at each side, with more (e.g., four connections at the corners) for taller walls 40. Further, walls 40 may be formed with multiple stacked spandrel panels 70, where the male and female connectors 90, 92 independently support each panel 70 on the wing walls 62, 64 (i.e., the bottom spandrel panel(s) 70 do not bear the weight of the top spandrel panel(s) 70). This eliminates the potential for cracking to occur where upper panels 70 bear and also allows for easy removal and replacement of an individual spandrel panel 70 if one happens to be damaged It should be appreciated that such a connection allows the spandrel panel 70 to be assembled to the wing walls 62, 64 without needing to raise the spandrel panel 70 beyond its assembled height any more than the height of the female connector locking member 260. Thus, special actions such as have been necessary to install walls in areas with height restrictions (e.g., under bridges) such as previously discussed are not required.

Figure 15:
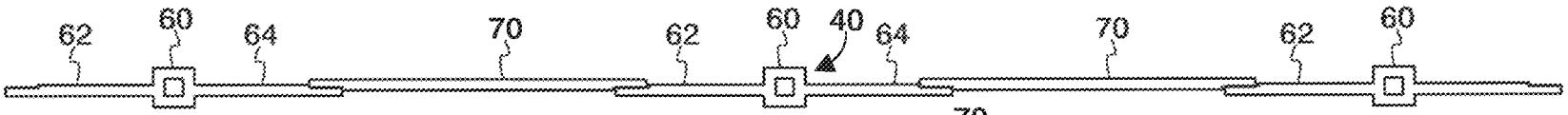
FIG. 15 is a top view of the sound attenuating wall showing a plurality or joined spandrel panels and columns with wing walls.

FIG. 15 illustrates a wall 40 with a plurality of columns 60 and integral wing walls 62, 64 assembled with spandrel panels 70. It should be appreciated that this construction also requires fewer piers 50, since the panels (which may be restricted in width due to strength and/or shipping requirements) do not require that piers be provided at spacings corresponding to the width of the panels. That is, for example, spandrel panels having a twenty (20) foot width do not require piers at the end of each 20 foot panel 70, but rather would require piers 50 only about every thirty (30) feet with wing walls 62, 64 which are six (6) feet wide and overlapping a foot with the sides of the spandrel panel 70, Reducing the number of piers 50 may not only reduce material requirements, but also may significantly further enhance the ease and speed of installation. Cost is further reduced by minimizing the need for installers of a variety of trades such as with many prior art installations.

Figure 17:
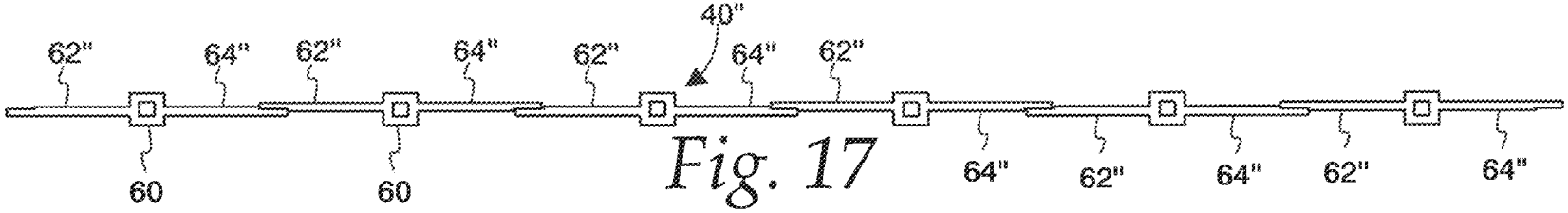
FIG. 17 is a top view of an alternate crash-worthy wall.
Figure 18:
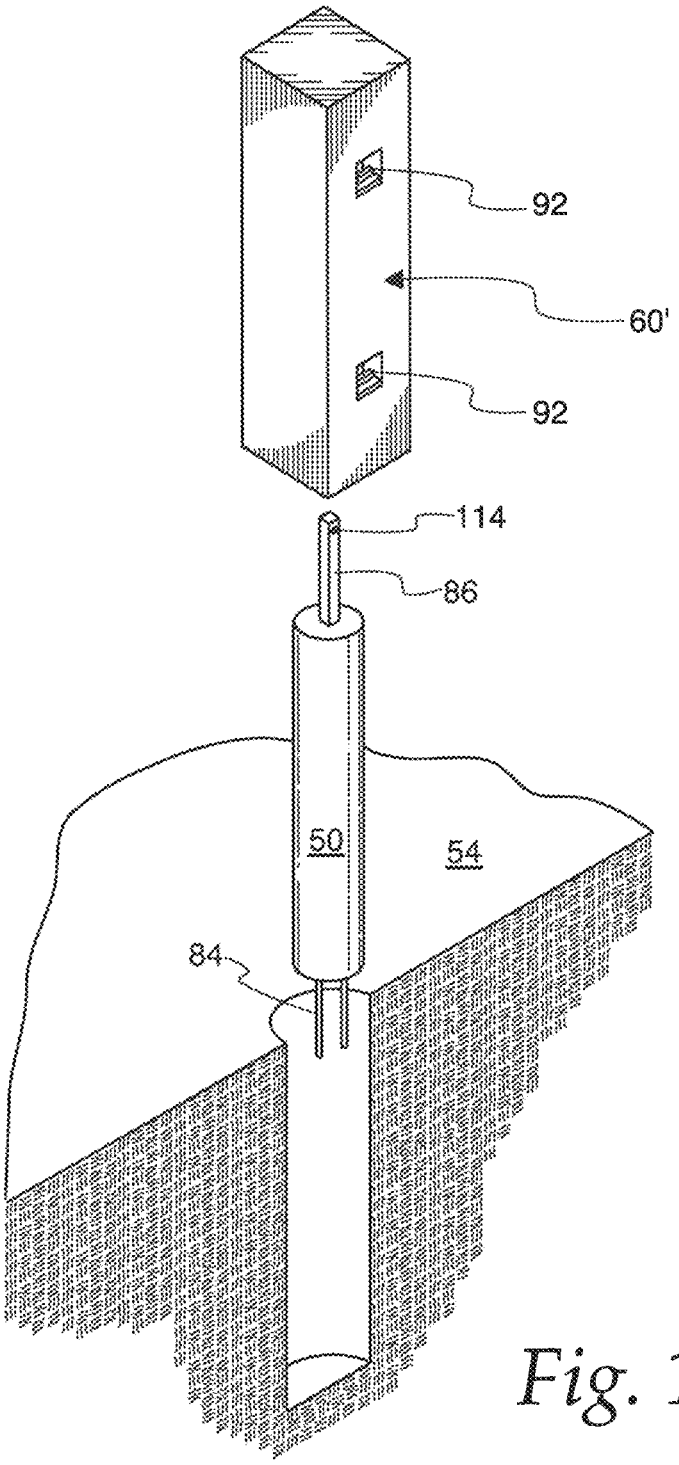
FIG. 18 is a perspective exploded view illustrating a column which may be used at the end of a wall.
Figure 19:
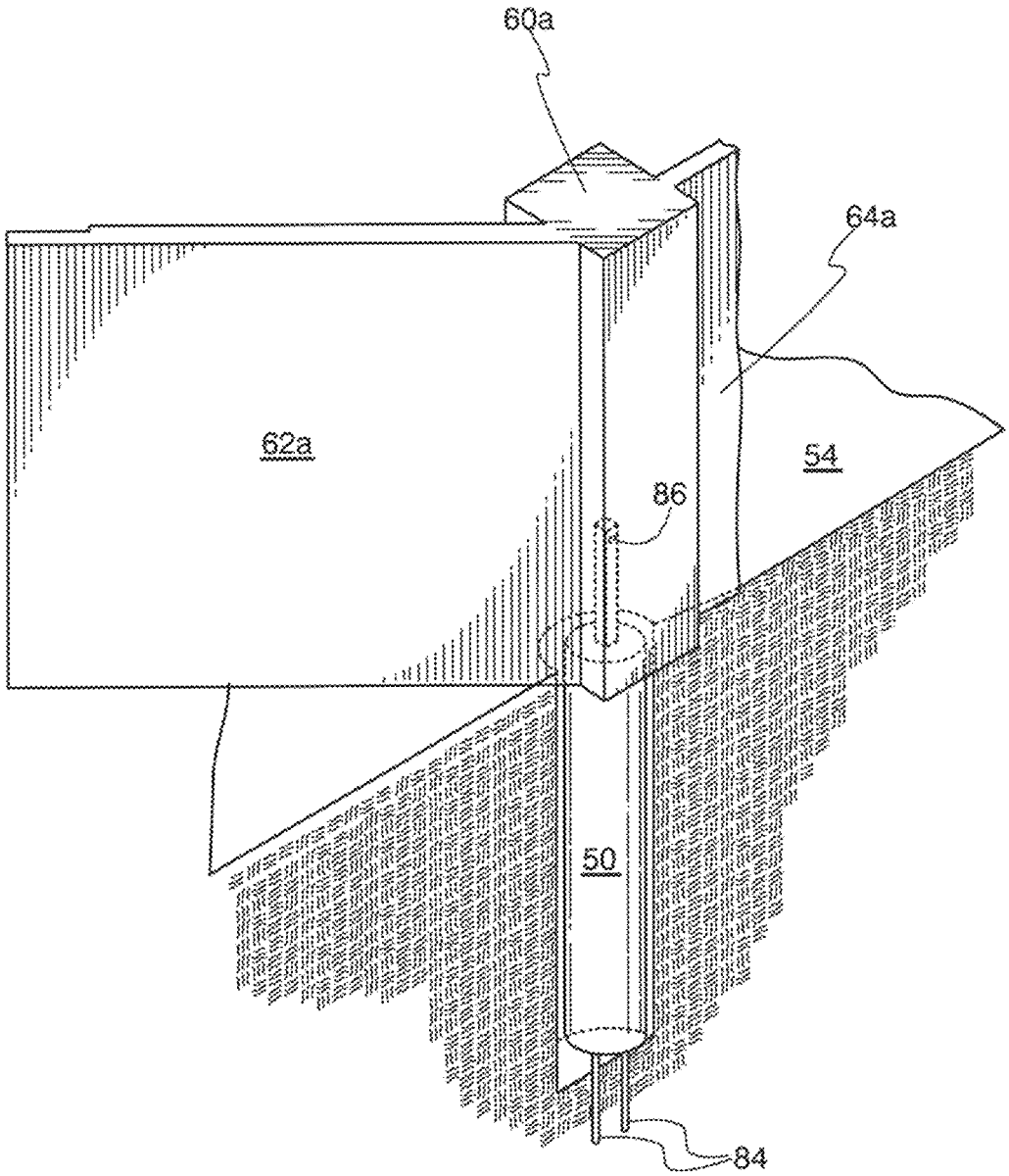
FIG. 19 is a view of an integrated precast column with wing walls which are not linearly aligned for use where corners are required in the wall.

FIGS. 17-19 show further variations of the sound attenuating walls which enjoy at least some of the advantages of the structure disclosed herein.

That is, FIG. 17 shows a wall 40" in which the column wing walls 62",64" are secured together (such as disclosed in FIGS. 9-12) without intervening spandrel panels and therefor providing increased strength, such as might be used where vehicles crashing into the wall 40" would be of a concern.

FIG. 18 illustrates a column 60' such as may be used at the end of a wall, where wing walls are not necessary. With such a column 60', female (or male) connectors 92 or 90 may be incorporated in the column 60' itself for securing to the outer side of the last spandrel panel 70.

FIG. 19 illustrates yet another column **60*a* which may be advantageously used, wherein the column 60*a* is precast with the wing walls 62*a*, 64*a*** at a selected angle based on the design configuration of a particular wall. Alternatively, columns with linearly aligned wing walls such as previously described herein may be used with a spandrel panel which is itself curved, with the adjacent wing walls at a curve or corner being aligned tangentially with the design curve of the spandrel panel. Horizontal turns or grade changes along the line of the proposed noise abatement wall system may thus be accomplished in an aesthetically pleasing manner which is essentially as easy to install as straight walls, without the need for special components and time-consuming steps such as with the prior art.

In addition to the numerous advantages of the wall as previously stated, it should be appreciated that numerous other advantages are provided.

For one, the components may be mostly (about 95%) precast with only a few structural steel components used to connect the components (the column member 88 and the connectors 90, 92). Thus, the precast contractor may realize a relatively large margin of return and fabrication and material acquisition may be accomplished more easily and quickly. Additionally, the precast components as described herein minimize the time required on-site to install a wall 40, with waiting time on-site being minimal (i.e., waiting is only required for the backfill around the piers 50 to sufficiently set). Of course, the column 60 with wing walls 62, 64 and the spandrel panels 70 may also be erected quickly due to the simplicity of the component connections and the reduced number of component parts.

Further, the need for fewer piers 50 as described herein results in numerous advantages beyond the time and cost savings of installing such piers 50. For example, fewer components creates cost savings (a) by increasing the efficiencies of the fabrication process by reducing the number of component parts that need to be fabricated, handled and positioned in the precast, (b) on shipping the components to the sight since fewer trips are required, (c) by reducing the number of components that need to be erected in the field, (d) by reducing the number of moves or setups by the on-site portable crane, and (e) by allowing for a compressed fabrication and erection process. Moreover, fewer components and elimination of field hardware in connections creates cost savings by reducing part acquisition logistics and waste of lost hardware during erection (e.g., small parts such as nuts and wrenches). Further, in addition to the basic savings associated with installation of fewer piers 50, reducing the number of augured holes reduces the potential for the auguring process interfering with existing underground utilities and/or natural impenetrable underground elements.

Such interferences can cause delays to the erection of the wall due to the design team having to find alternate solutions and potentially having to redesigned and fabricated portions of the wall system. Still further, fewer components create cost savings by reducing the quantity of wall joints which reduces the field application of structural or fire retardant caulk.

Still further, the precast concrete piers 50 can be fabricated and installed during any weather as long as the augured hole can be maintained. Additionally, the augured hole is not left open as long using a precast pier system as has been required with prior art cast-in-place systems. This reduces the chance of inclement weather from damaging the undisturbed soil at the bottom and sides of an augured hole.

Additionally, the disclosed wall 40 lends itself to easy replacement of deteriorated or damaged existing walls. That is, since the piers 50 may be spaced at greater distances than the piers of prior art walls, location of new piers 50 to avoid conflict with the old wall structure may be avoided.

The invention claimed is:

1. A wall for abating noise from a noisy area, comprising:

a plurality of columns each precast monolithically and integral with a pair of wing walls extending laterally from the column with each wing wall having front and rear faces extending laterally from said column to an outer side spaced from the column, said columns each being secured in a vertical orientation adjacent said noisy area with said wing wall outer sides have a selected spacing from one wing wall outer side of an adjacent column;

a spandrel panel having front and rear faces extending between opposite sides, said opposite sides being spaced greater than said selected spacing of wing walls of adjacent columns whereby said spandrel panel front face adjacent one of said panel opposite sides overlaps said rear face of one of the wing walls of one of said adjacent columns, and said spandrel panel front face adjacent the other of said panel opposite sides overlaps said rear face of one of the wings walls of said other adjacent column; and first connectors on said spandrel panel front face adjacent both of said panel opposite sides and second connectors on said wing wall rear faces adjacent said wing wall outer sides, said first and second connectors connected together to secure said overlapping walls and spandrel panels in substantially face to face contact.

2. The wall of claim 1, further comprising:

a plurality of piers each with a column member, each of said piers secured in ground holes adjacent the noisy area with said column member extending vertically from the pier above the ground and spaced from at least one adjacent pier; and a center recess in said plurality of columns receiving said pier column members to support said plurality of columns in a vertical orientation.

3. The wall of claim 2, wherein said piers are each precast concrete formed integrally with a steel pillar extending above said pier to define said column members.

4. The wall of claim 3, wherein said piers are each secured in a ground hole larger than said pier with fill closing the ground hole after the pier is positioned in the ground hole, and further comprising rebar extending downwardly from said precast concrete pier and into said ground securing the position of the pier as the fill is added to the ground hole.

5. The wall of claim 4, further comprising a stand securing the position of said pillar while fill is added to the ground hole.

6. The wall of claim 5, wherein the fill is CLSM concrete.

7. The wall of claim 1, wherein:

said first connectors comprise a plurality of projections from said spandrel panel front face adjacent said panel opposite sides; and said second connectors comprise a plurality of recesses into the wing walls through said wing wall rear faces adjacent said wing wall outer sides;

wherein said first connector projections when received in said second connector recesses bias said spandrel panel front face into engagement with said rear faces of said wing wall.

8. The wall of claim 7, wherein:

said first connector projections each include a downwardly extending locking member having a sloped surface generally facing said panel vertical front face;

said second connector recesses each include an upwardly extending locking member having a sloped surface generally facing into said second connector recesses; and said first connector downwardly facing members are located behind said second connector upwardly facing members in said recesses with said downwardly extending locking member sloped surfaces engaging said upwardly extending locking member sloped surfaces whereby said locking member sloped surfaces interact to bias said spandrel panel front face against said wing wall rear faces.

9. A method of assembling a wall for abating noise from a noisy area, comprising the steps of:

precasting a plurality of piers, a plurality of columns, each column being precast monolithically and integral with a pair of wing walls extending laterally from the column, and a plurality of spandrel panels;

digging at least two ground holes adjacent the noisy area;

in each ground hole securing one of said piers with a pier column member oriented vertically;

adding CLSM fill to said ground holes and allowing said CLSM fill to cure around said pier;

lowering said columns onto said pier column members to secure said columns in a vertical orientation with wing walls of adjacent columns at said selected spacing;

suspending one of said spandrel panels above the ground between said wing walls of adjacent columns with locking members of first connectors higher than locking members of second connectors;

moving said suspended spandrel panel toward said wing walls to locate said first connectors in said second connector recesses with said first connector locking members behind said second connector locking members in said second connector recesses; and lowering said suspended spandrel panel whereby locking member sloped surfaces interact to bias a front face of said spandrel panel against rear faces of said wing walls.

10. A wall for abating noise from a noisy area, comprising:

a plurality of piers with integral column members, each of said piers secured in ground holes adjacent the noisy area with said integral column member extending vertically from the pier above the ground and spaced from at least one adjacent pier;

a plurality of columns each including a pair of wing walls extending laterally from the column, each of said columns and included wing walls being integrally formed of precast concrete with each wing wall having front and rear faces extending laterally from said column to an outer side spaced from the column, said columns each being secured in a vertical orientation to said pier column members whereby said wing wall outer sides have a selected spacing from one wing wall outer side of an adjacent column secured to said adjacent pier;

a spandrel panel having front and rear faces extending between opposite sides, said opposite sides being spaced greater than said selected spacing of wing walls of adjacent columns whereby said spandrel panel front face adjacent one of said panel opposite sides overlaps said rear face of one of the wing walls of one of said adjacent columns, and said spandrel panel front face adjacent the other of said panel opposite sides overlaps said rear face of one of the wings walls of said other adjacent column; and first connectors on said spandrel panel front face adjacent both of said panel opposite sides and second connectors on said wing wall rear faces adjacent said wing wall outer sides, said first and second connectors connected together to secure said overlapping walls and spandrel panels in substantially face to face contact.

11. The wall of claim 10, wherein said spandrel panels and wing walls are supported in a substantially vertical orientation.

12. The wall of claim 10 wherein said piers, columns and spandrel panels are formed of precast concrete prior to assembly at the noisy area.

13. The wall of claim 10, wherein:

said first connectors comprise a plurality of projections from said spandrel panel front face adjacent said panel opposite sides;

said second connectors comprise a plurality of recesses into the wing walls through said wing wall rear faces adjacent said wing wall outer sides;

wherein said first connector projections when received in said second connector recesses bias said spandrel panel front face into engagement with said rear faces of said wing wall.

14. The wall of claim 13, wherein:

said first connector projections each include a downwardly extending locking member having a sloped surface generally facing said panel front face;

said second connector recesses each include an upwardly extending locking member having a sloped surface generally facing into said second connector recesses; and said first connector downwardly facing members are located behind said second connector upwardly facing members with said downwardly extending locking member sloped surfaces engaging said upwardly extending locking member sloped surfaces whereby said locking member sloped surfaces interact to bias said spandrel panel front face against said wing wall rear faces.

15. A method of assembling the spandrel panels and wing walls of claim 14, comprising the steps of:

suspending one of said spandrel panels above the ground;

positioning the suspended spandrel panel between adjacent spaced wing walls with said locking members of said first connectors higher than the locking members of said second connectors;

moving said suspended spandrel panel toward said wing walls to locate said first connectors in said second connector recesses with said first connector locking members behind said second connector locking members in said second connector recesses; and lowering said suspended spandrel panel whereby said locking member sloped surfaces interact to bias said spandrel panel front face against said wing wall rear faces.

* * * * *